US010655365B2

(12) United States Patent
Benson et al.

(10) Patent No.: US 10,655,365 B2
(45) Date of Patent: May 19, 2020

(54) GATE LATCH ASSEMBLY

(71) Applicant: FENIX MANUFACTURING. CO., LLC, Fulton, IL (US)

(72) Inventors: John Benson, Sterling, IL (US); Randall Boonstra, Fulton, IL (US)

(73) Assignee: FENIX MANUFACTURING CO., LLC, Fulton, IL (US)

( * ) Notice: Subject to any disclaimer, the term of this patent is extended or adjusted under 35 U.S.C. 154(b) by 432 days.

(21) Appl. No.: 15/631,919

(22) Filed: Jun. 23, 2017

(65) Prior Publication Data

US 2018/0371801 A1 Dec. 27, 2018

(51) Int. Cl.

| | |
|---|---|
| ***E05B 65/00*** | (2006.01) |
| ***E05C 3/14*** | (2006.01) |
| ***E05C 19/10*** | (2006.01) |
| ***E05C 3/00*** | (2006.01) |

(52) U.S. Cl.

CPC ..... *E05B 65/0007* (2013.01); *E05C 3/14* (2013.01); *E05C 19/10* (2013.01); *E05B 65/00* (2013.01); *E05C 3/00* (2013.01); *Y10T 292/03* (2015.04); *Y10T 292/0839* (2015.04); *Y10T 292/0969* (2015.04); *Y10T 292/0995* (2015.04); *Y10T 292/1006* (2015.04); *Y10T 292/1007* (2015.04); *Y10T 292/1011* (2015.04); *Y10T 292/1013* (2015.04)

(58) Field of Classification Search

CPC ..... E05B 65/0007; E05B 65/00; E05C 3/14; E05C 19/10; E05C 3/00; Y10T 292/03; Y10T 292/0969; Y10T 292/0995; Y10T 292/1006; Y10T 292/1007; Y10T 292/1011; Y10T 292/1013; Y10T 292/0839

USPC ..... 292/DIG. 29

See application file for complete search history.

(56) References Cited

U.S. PATENT DOCUMENTS

| | | | | | |
|---|---|---|---|---|---|
| 37,567 | A | | 2/1863 | Cooper | |
| 1,591,363 | A | | 7/1926 | Herzing | |
| 1,798,170 | A | * | 3/1931 | Roedding | E05C 1/16 292/169.21 |
| 1,915,395 | A | * | 6/1933 | Welling | A45C 11/10 206/1.5 |
| 2,190,080 | A | | 2/1940 | Ott | |
| 2,627,433 | A | | 2/1953 | Wolfe | |
| 2,819,603 | A | * | 1/1958 | Levine | E05B 65/50 70/74 |
| 3,647,251 | A | * | 3/1972 | Brown | E05B 65/0817 292/111 |
| 4,062,575 | A | * | 12/1977 | Robins | E05C 3/167 292/67 |
| 4,083,591 | A | | 4/1978 | Parisien | |
| 4,938,508 | A | * | 7/1990 | Thomas | E05C 3/047 292/106 |

(Continued)

*Primary Examiner* — Carlos Lugo
*Assistant Examiner* — Faria F Ahmad
(74) *Attorney, Agent, or Firm* — Greer, Burns & Crain, Ltd.

(57) ABSTRACT

A gate latch assembly including an actuating member, a moveable rod, and a strike plate. The actuating member transfers movement of a first handle to a second handle. The actuating member includes a cam surface which interacts with the moveable rod to transition the gate latch assembly from a locked configuration to an unlocked configuration. A biasing element biases the actuating member.

18 Claims, 6 Drawing Sheets

(56) References Cited

U.S. PATENT DOCUMENTS 5,129,691 A 7/1992 McFarlen
5,284,036 A 2/1994 Rosenbaum
5,404,734 A * 4/1995 Martinez ..... E05B 67/36 137/285
5,425,560 A * 6/1995 Andersen ..... E05B 83/30 292/146
5,452,544 A * 9/1995 Weathington, Sr. ..... A01K 1/0017 292/128
5,498,041 A 3/1996 Bezzerides et al.
5,655,801 A 8/1997 Casey
5,931,032 A 8/1999 Gregory
6,017,068 A * 1/2000 Hughes ..... E05C 19/009 292/283
6,347,819 B1 * 2/2002 Plaxco ..... E05B 65/0007 292/228
6,609,739 B1 * 8/2003 Avganim ..... E05B 67/36 292/288
6,834,896 B2 12/2004 Smith
6,898,953 B1 * 5/2005 Paprocki ..... E05B 13/002 292/285
7,021,678 B1 * 4/2006 Raoult ..... A01K 1/0017 256/1
7,272,963 B2 9/2007 Rosenberg et al.
7,278,284 B1 * 10/2007 James ..... E05B 13/002 292/205
7,726,706 B2 * 6/2010 Moran ..... A01K 1/0356 292/194
7,967,345 B2 * 6/2011 Davies ..... E05B 65/0876 292/336.3
8,353,543 B2 * 1/2013 Harrison ..... E05B 13/001 292/207
8,678,451 B2 3/2014 Martin
9,297,187 B2 3/2016 Glover
2005/0061041 A1 * 3/2005 Rosenberg ..... E05B 65/0007 70/129
2005/0173930 A1 * 8/2005 Geisthardt ..... E05B 65/0007 292/61
2005/0183479 A1 * 8/2005 Alacqua ..... E05B 47/0009 70/277
2007/0080544 A1 4/2007 Pachello et al.
2013/0249221 A1 9/2013 Arssinous et al.
2013/0270412 A1 * 10/2013 Bogoslofski ..... B60R 9/048 248/551
2013/0270842 A1 * 10/2013 Martin ..... E05C 3/14 292/210
2014/0317893 A1 * 10/2014 Takahashi ..... A44B 11/2546 24/580.11
2014/0318193 A1 * 10/2014 Lin ..... E05B 73/0082 70/58
2015/0076839 A1 * 3/2015 Eckberg ..... E05C 3/14 292/219
2015/0259964 A1 * 9/2015 Linehan ..... E05B 1/0053 49/272
2018/0112457 A1 * 4/2018 Raffi ..... E05C 19/06
2019/0234112 A1 * 8/2019 Hong ..... E05B 15/0033

* cited by examiner

GATE LATCH ASSEMBLY

BACKGROUND

This disclosure relates generally to a gate latch assembly, and more particularly to a gate latch assembly that includes two handles, one on each side of the gate.

Latches for securing gates that pivot open are known. Such conventional latches typically include a rod and a hook that engages the rod to secure the gate closed. An articulating member usually located on an exterior of the gate is typically used to disengage the rod from the hook, allowing the gate to be opened.

While these gate latches are presumably effective for their intended purposes, some latches have separate latching structures and handles. This may require the use of two hands to open such a gate.

Additionally, some current gate latch systems have complex locking mechanisms. These types of systems often require additional time for installation.

Accordingly, there is a need for developing a gate latch assembly that addresses one or more of the above-identified drawbacks.

SUMMARY

The above-mentioned need is met or exceeded by the present gate latch assembly. An important feature of the present gate latch assembly is having an actuating member for transferring lateral movement between two handles on opposite sides of the gate door.

Another important feature of the present gate latch assembly is a biasing element which biases the actuating member into a locking position.

Yet an additional important feature of the present gate latch assembly is allowing the opening and the unlocking of the gate door to occur as a result of a single motion, from either side of the gate door. This lateral movement of the actuating member under user control overcomes the force of an internal biasing member to move a rod of a default locking position.

With such configurations, a simple, yet effective, mechanism for locking and unlocking is provided.

Accordingly, a gate latch assembly for selectively latching a gate door closed is provided including an actuating member, a strike plate, and a moveable rod. A middle portion of the actuating member is positioned between a first handle and a second handle. Movement of one of the first or second handles is transferred to the other by the actuating member. A cam surface is included in the actuating member. The moveable rod is configured to engage the cam surface of the actuating member to transition the gate latch assembly from a locked configuration, in which said rod engages a hook in the strike plate, to an unlocked configuration, in which the rod is free from the hook of the strike plate.

Moreover, a gate latch assembly for selectively latching a gate door closed is also provided which includes an actuating member, a biasing element, a strike plate, and, a moveable rod. A first end of the actuating member forms a first handle and a second end forming a second handle. A cam surface is also included in the actuating member. The biasing element is configured to bias the actuating member, and the strike plate includes a hook. Also, the moveable rod is configured to engage the cam surface to change the gate latch assembly from a locked configuration, in which the rod engages said hook, to an unlocked configuration, in which the rod is free from the hook.

Additional aspects, embodiments, and details of the present disclosure, all of which may be combinable in any manner, are set forth in the following detailed description of the disclosure.

BRIEF DESCRIPTION OF THE DRAWINGS

One or more exemplary embodiments of the present disclosure will be described below in conjunction with the following drawing figures, in which.

DETAILED DESCRIPTION

With these general principles in mind, one or more embodiments of the present disclosure will be described with the understanding that the following detailed description is not intended to be limiting.

Figure 1:
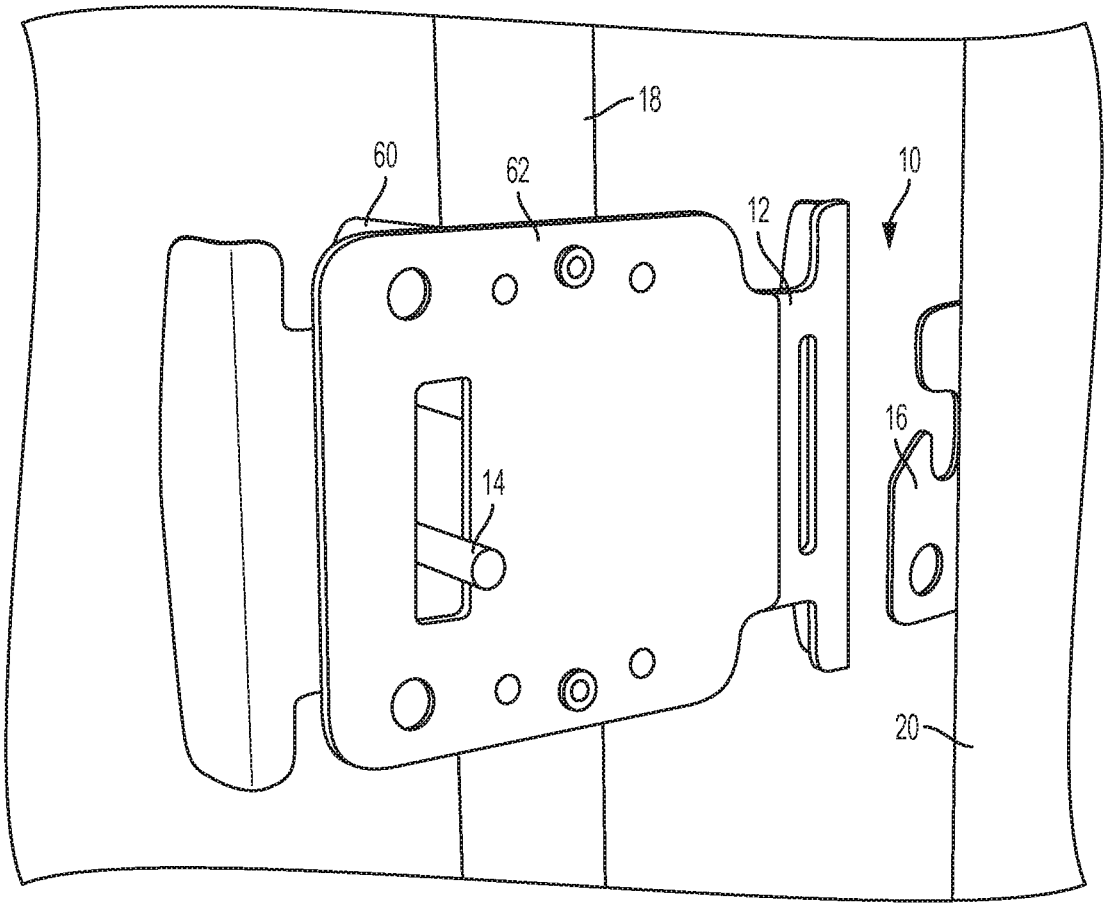
FIG. 1 is a front and side perspective view of the present gate latch assembly in an unlocked configuration.
Figure 2:
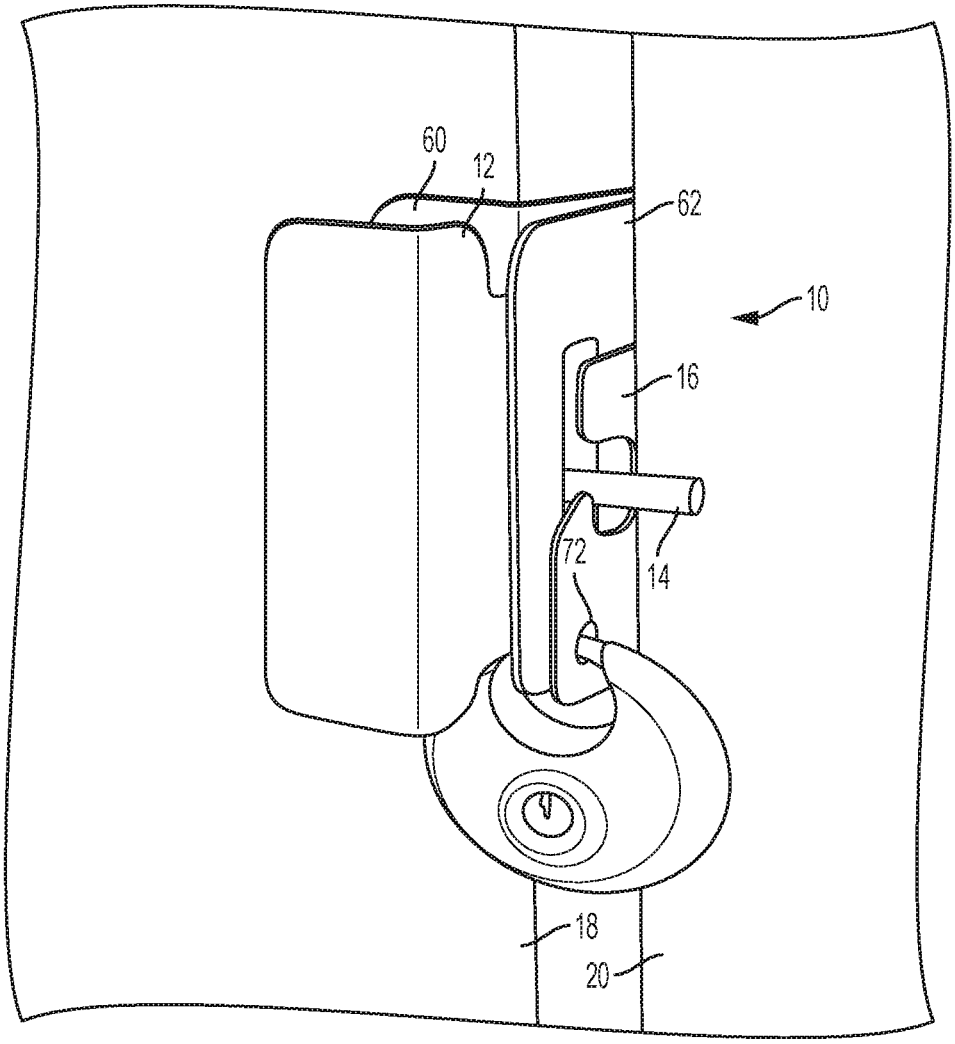
FIG. 2 is a front and side perspective view of the gate latch assembly from FIG. 1 in a locked configuration.

Referring now to FIGS. 1 and 2, a gate latch assembly is generally designated 10 and includes an actuating member 12, a moveable rod 14, and a strike plate 16. The gate latch assembly 10 provides a latch between a gate door 18 and a gate post 20.

In FIG. 1, the rod 14 is free from the strike plate 16, allowing the gate door 18 to be opened. This is referred to as the unlocked configuration. In contrast, for the locked configuration, shown in FIG. 2, the rod 14 engages the strike plate 16, preventing the gate door 18 from being opened.

In FIGS. 1 and 2, the rod 14 and the actuating member 12 are associated with the gate door 18, while the strike plate 16 is associated with the gate post 20. This is merely a preferred configuration and other configurations are contemplated, including the opposite configuration.

Turning now to FIGS. 3 to 6, the actuating member 12 is shown in more detail. The actuating member 12 transfers linear movement (i.e., side to side movement) between a first handle 22 and a second handle 24. The first and second handles 22, 24 are intended to be gripped or grasped by a user to both open the gate door 18, as well as disengage the rod 14 from the strike plate 16 (discussed in more detail below). Thus, the first handle 22 is located on a first side of the gate door 18 (see FIGS. 1 and 2), while the second handle 24 is located on a second, opposite side of the gate door 18.

In a preferred confirmation, the actuating member 12 is integrally formed with the first and second handles 22, 24. Accordingly, the actuating member 12 includes a middle portion 26 that is generally planar. A first end 28 of the actuating member 12 forms the first handle 22 and a second, opposite end 30 of the actuating member 12 forms the second handle 24. The first and second handles 22, 24 are preferably formed by bending the ends 28, 30 of the actuating member 12, at 90° angles relative to the middle portion 26. Other configurations are contemplated.

In order for the gate latch assembly 10 to transition from a locked configuration (in which the rod 14 is engaged with the strike plate 16) to an unlocked configured (in which the rod 14 is disengaged, or free, from the strike plate 16), the actuating member 12 includes a cam surface 32. In a preferred configuration, the cam surface 32 is a portion of a cutout 34 in the actuating member 12 so that the rod 14 passes through the actuating member 12. The rod 14 rests on the cam surface 32 (see, FIGS. 8 and 12, discussed below) and is moved up and down as a result of the lateral (side to side) movement of the actuating member 12.

Figure 3:
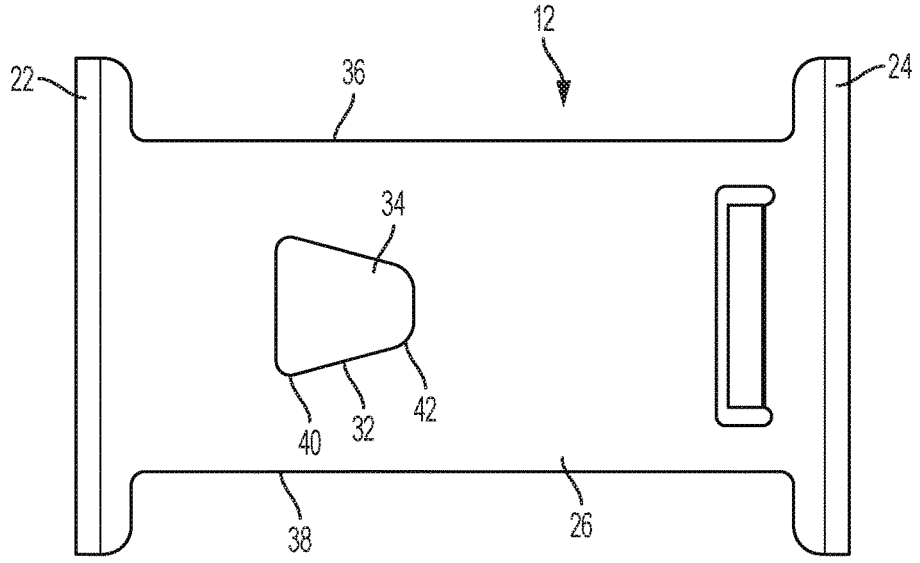
FIG. 3 is a side view of an actuating member for the present gate latch.
Figure 4:
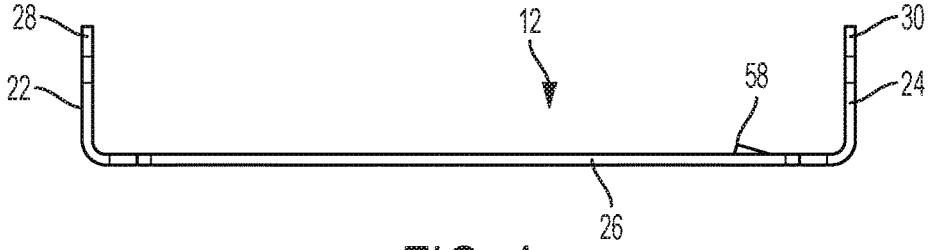
FIG. 4 is a top view of the actuating member shown in FIG. 3.
Figure 5:
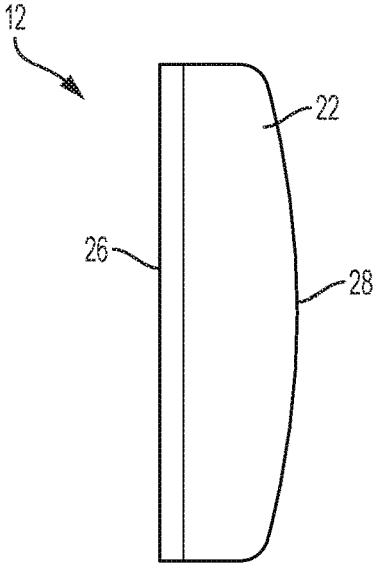
FIG. 5 is a front view of the actuating member shown in FIG. 3.

As shown in FIG. 3, the middle portion 26 of the actuating member 12 includes a top edge 36 and a bottom edge 38 parallel to the top edge 36. The cam surface 32 includes a linear segment with a first end 40 and a second end 42. The first end 40 of the cam surface 32 is closer to the bottom edge 38 of the middle portion 26 than the top edge 36 of the middle portion 26 compared with the second end 42 of the cam surface 32. In a preferred configuration, the cutout 34 has a trapezoidal shape. Other shapes for the cutout 34 and design of the cam surface 32 are contemplated. For example, instead of the cam surface 32 being linear, it is contemplated that the cam surface 32 is curved with either an increasing or a decreasing slope.

Turning to FIGS. 6 to 13, a gate latch assembly 10 is shown in more detail. The locked configuration of the gate latch assembly 10 is shown in FIGS. 6 to 9, in which the rod 14 is engaged with the strike plate 16. Specifically, the strike plate 16 includes a hook 50 that receives the rod 14. As mentioned above, the rod 14 is secured to the gate door 18. Accordingly, with reference to FIGS. 7 and 9, a fastener 44 secures one end 46 of the rod 14 (to the gate door 18 for example). A second, free end 48 of the rod 14 is movable—allowing the gate latch assembly 10 to change between the locked and unlocked configurations.

Figure 6:
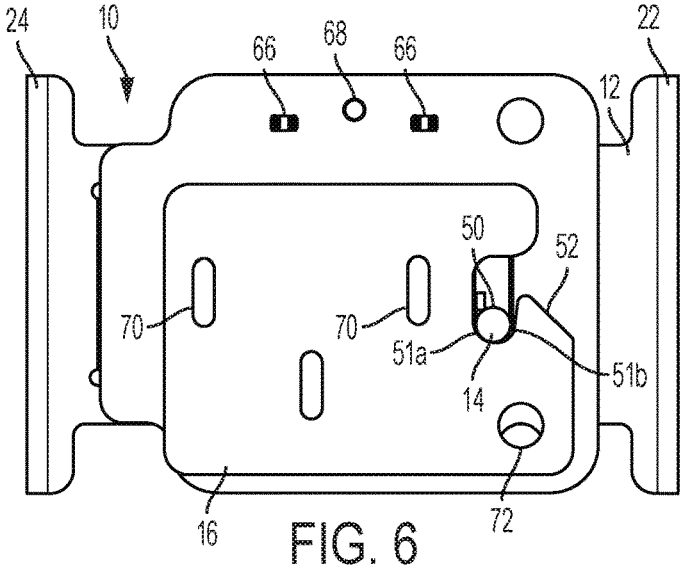
FIG. 6 is a left side view of the present gate latch assembly in an unlocked configuration.
Figure 7:
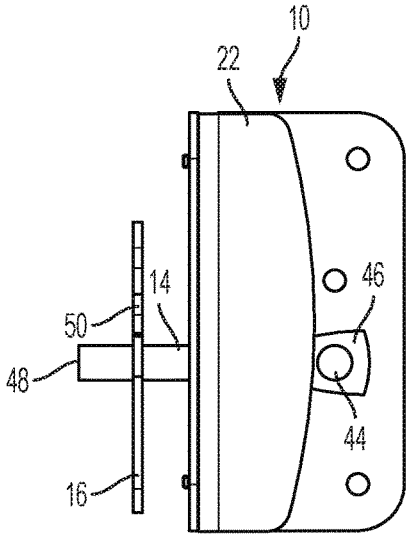
FIG. 7 is a front view of the gate latch assembly shown in FIG. 6.
Figure 14:
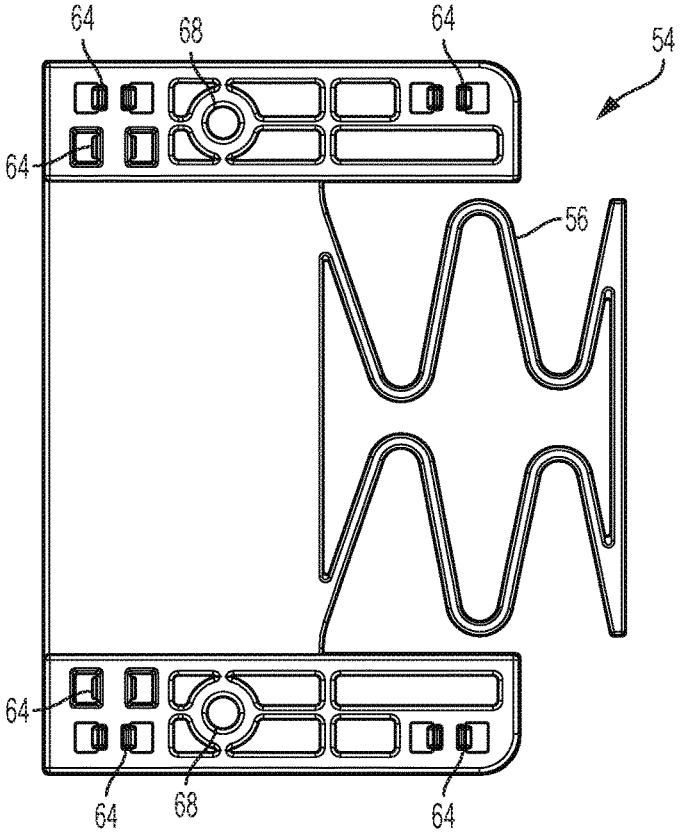
FIG. 14 is a side view of a biasing element for the present gate latch assembly; and, FIG. 15 is a front view of the biasing element show in FIG. 14.

As shown in FIGS. 6 and 14, the hook 50 includes sidewalls 51*a*, 51*b* that are sized to preclude the second end 48 of the rod 14 from moving laterally—thus preventing the gate door 18 from being pivoted opened relative to the gate post 20. In order to allow the gate door 18 to be opened, the gate latch assembly 10 must transition to the unlocked configuration.

Accordingly, a force is applied to either the first handle 22 or the second handle 24. For example, the first handle 22 can be pulled in a direction away from the second handle 24 (i.e., from the right to the left of FIG. 8). Preferably, this direction is the same direction that the gate door 18 will pivot when the gate latch assembly 10 is in the unlocked configuration. Additionally, the second handle 24 can be pushed towards the first handle 22 (again, from the right to the left of FIG. 8). It is preferred this direction is also the same direction that the gate door 18 will pivot when the gate latch assembly 10 is in the unlocked configuration.

Figure 8:
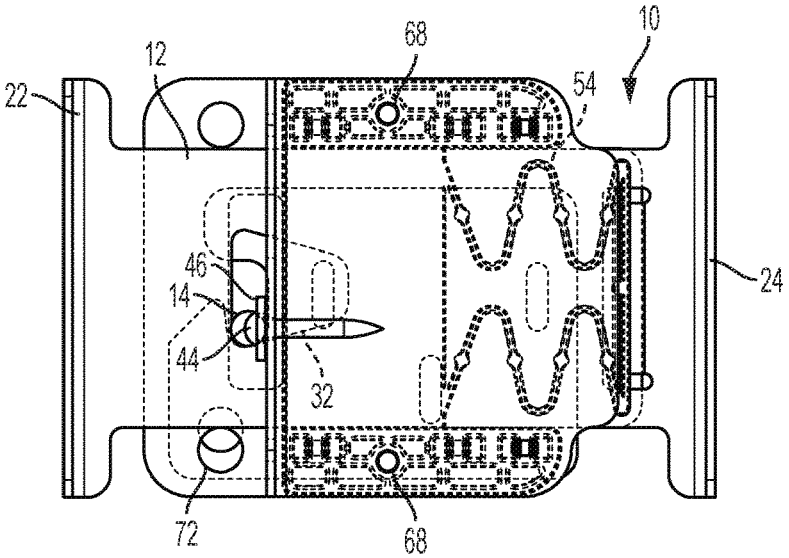
FIG. 8 is a right side view of the gate latch assembly shown in FIG. 6 with some portions shown in dashed lines.

Due to the force applied to the one of the handles 22, 24, the actuating member 12 moves laterally from the right to the left of FIG. 8. The free end 48 of the rod 14 moves upward by the cam surface 32 as the height of the cam surface 32 increases while the actuating member 12 is moved laterally relative to the rod 14.

Eventually, the second end 48 of the rod 14 moves high enough to clear the hook 50 in the strike plate 16. This is the unlocked configuration shown in FIGS. 10 to 13 in which the rod 14 is free from (or does not engage) the hook 50. From the unlocked configuration, the gate door 18 can be opened.

In order to transition the gate latch assembly 10 from the unlocked configuration to the locked configuration, the notch 50 of the strike plate 16 includes a ramped surface 52. The ramped surface 52 engages the second end 48 of the rod 14 to lift the rod 14 over the hook 50.

A feature of the present gate latch assembly 10 is a biasing element 54 for biasing the actuating member 12. The biasing member 54 also biases the rod 14, preferably to a locking position, in which the rod 14 is positioned such that it would engage the hook 50 if the gate door 18 was closed. Thus, regardless of the positioning of the rod 14 and the strike plate 16, once the force applied to the gate latch assembly 10 to change to the unlocked position is removed, the rod 14 will move (as a result of the actuating member 12, and more specifically the cam surface 32 moving) from the position shown in FIGS. 10 to 13 (the unlocked position) to the position shown in FIGS. 6 to 9 (the locking position).

Figure 12:
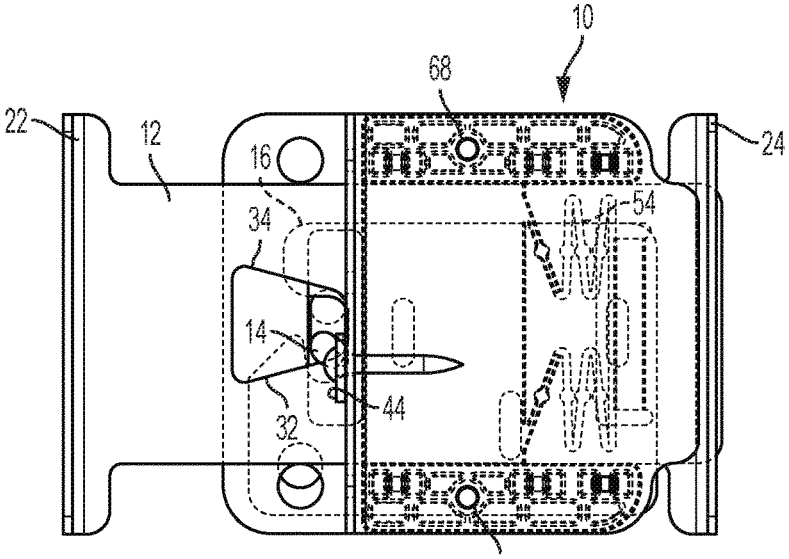
FIG. 12 is a right side view of the gate latch assembly shown in FIG. 10 with some portions shown in dashed lines.
Figure 15:
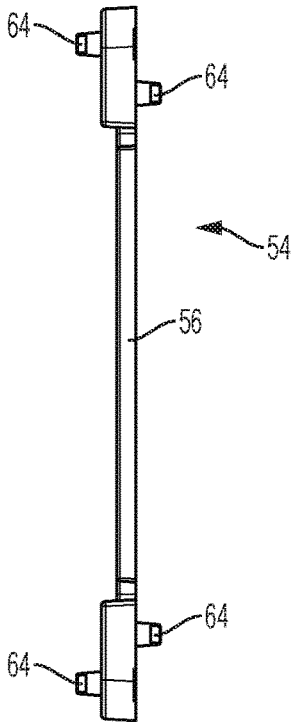

With reference to FIGS. 14 and 15, the depicted biasing element 54 is formed from a thermoplastic material that has resiliency and is resistant to environmental degradation. As depicted, the biasing element 54 includes a bellows portion 56 that engages a wedge 58 of the actuating member 12 (see FIGS. 4 and 9). As the actuating member 12 moves, the bellows portion 56 is compressed (FIG. 12). Once the force applied to the actuating member 12 is removed, the bellows portion 56 returns to its original, uncompressed configuration (FIGS. 8 and 14). Due to the engagement between the wedge 58 and the bellows portion 56, the actuating member 12 will move back to its original position. As mentioned above, this will allow the rod 14 to return to the locking position (whether in the hook 50 or not).

Figure 9:
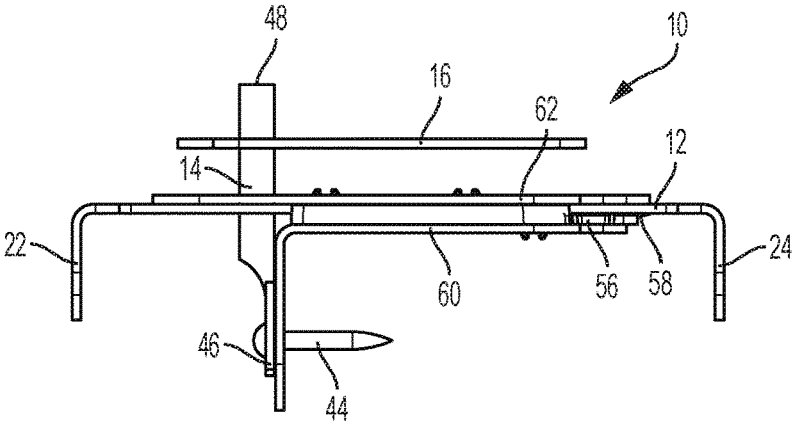
FIG. 9 is a top view of the gate latch assembly shown in FIG. 6.
Figure 10:
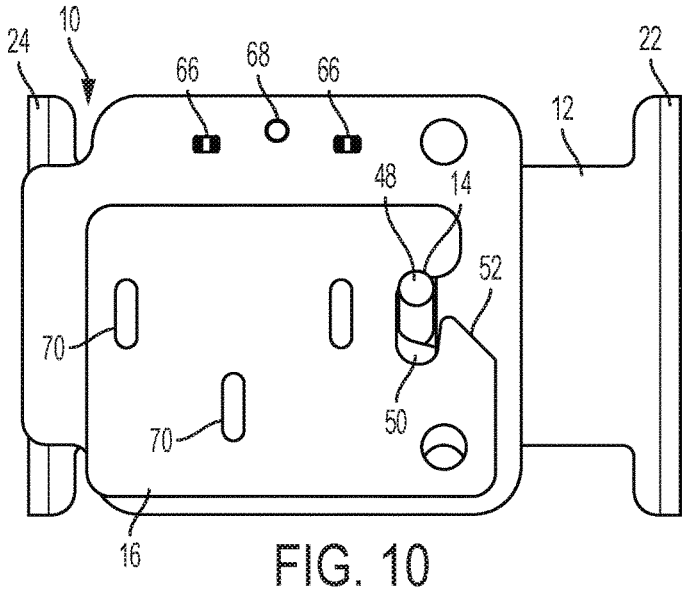
FIG. 10 is a left side view of the gate latch assembly shown in FIG. 6 in an unlocked configuration.
Figure 11:
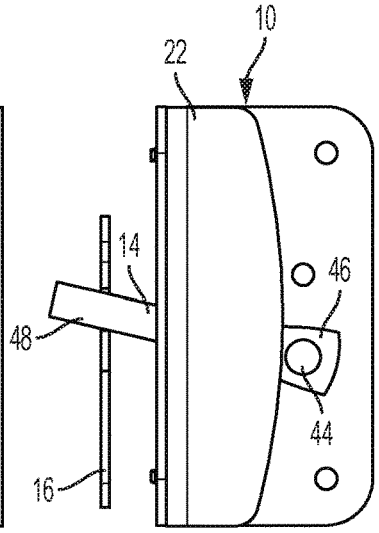
FIG. 11 is a front view of the gate latch assembly shown in FIG. 10.
Figure 13:
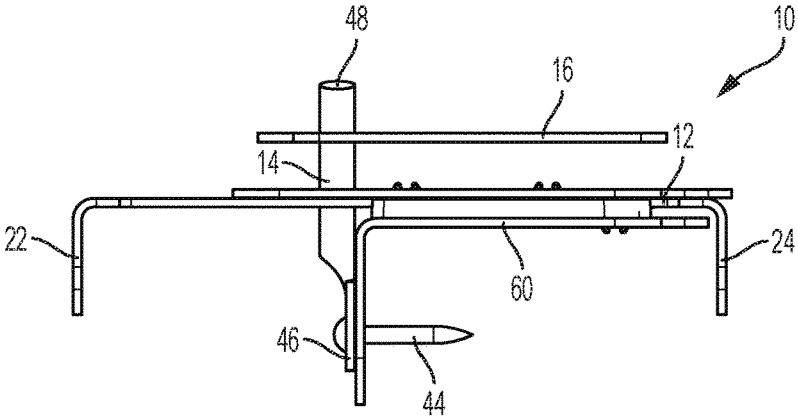
FIG. 13 is a top view of the gate latch assembly shown in FIG. 10.

As shown in FIGS. 9 and 13, the biasing element 54 may be housed between an inner plate 60 and an outer plate 62. The actuating member 12, or at least a portion thereof, extends through the inner and outer plates 60, 62.

Returning to FIGS. 14 and 15, the biasing element 54 includes one or more attachment posts 64 on opposite sides. The inner and outer plates 60, 62 include apertures 66 which receive the attachment posts 64 to fasten the plates 60, 62 to the biasing element 54 (see, e.g., FIGS. 6 and 10).

With reference to FIGS. 6, 8, 10, and 12, mounting apertures 68 passing through the inner and outer plates 60, 62, as well as the biasing element 54, to receive fasteners (not shown) used to mount the assembly to the gate door 18. The strike plate 16 also includes mounting apertures 70 for likewise receiving fasteners used to mount the strike plate 50 to the gate post 20.

Additionally, with reference to FIGS. 6 and 8, the strike plate 16 and the outer plate 62 preferably includes locking apertures 72 that allow for insertion a secondary locking device, like a pad lock, clip, or other such device (see FIG. 2).

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure, it being understood that various changes may be made in the function and arrangement of elements described in an exemplary embodiment without departing from the scope of the disclosure.

What is claimed is:

1. A gate latch assembly for selectively latching a gate door closed, the gate latch assembly comprising:

an actuating member comprising a first end with a first handle, a second end opposite the first end with a second handle, and a middle portion between the first end and the second end, said actuating member configured to transfer movement of one of said first and second handles to the other of said first and second handles, wherein said actuating member includes a cam surface;

a strike plate having a hook; and, a moveable rod configured to engage said cam surface of said actuating member to transition the gate latch assembly from a locked configuration, in which said rod engages said hook, and an unlocked configuration, in which said rod is free from said hook, said rod having a first end pivotably mounted to the gate door with a fastener, wherein said first handle is located on a first side of said gate door and said second handle is located on a second side of said gate door, and, wherein said middle portion of said actuating member comprises a cutout, and wherein a portion of said cutout forms said cam surface.

2. The gate latch assembly of claim 1, wherein at least one of said first and second handles is integrally formed with said actuating member.

3. The gate latch assembly of claim 2, wherein both of said first and second handles are integrally formed with said actuating member.

4. The gate latch assembly of claim 1, wherein said cutout comprises a trapezoid.

5. The gate latch assembly of claim 1, wherein said middle portion of said actuating member comprises a top edge and a bottom edge, said top and bottom edge being parallel, and wherein said cam surface comprises a linear surface with a first end and a second end, said first end being closer to said bottom edge than said top edge when compared with said second end.

6. The gate latch assembly of claim 5, further comprising a biasing element configured to bias said actuating member.

7. The gate latch assembly of claim 6, wherein said biasing element comprises a bellows.

8. The gate latch assembly of claim 5, wherein a force exerted on said first handle in a first direction causes said actuating member to move such that said second end of said linear surface moves closer to said rod.

9. The gate latch assembly of claim 8, wherein a force exerted on said second handle in the first direction causes said actuating member to move such that said second end of said linear surface moves closer to said rod.

10. A gate latch assembly for selectively latching a gate door closed, the gate latch assembly comprising:

an actuating member comprising a first end forming a first handle and a second end forming a second handle, and said actuating member further comprising a cam surface;

a biasing element configured to bias said actuating member;

a strike plate having a hook; and, a moveable rod configured to engage said cam surface to transfer said gate latch assembly from a locked configuration, in which said rod engages said hook, to an unlocked configuration, in which said rod is free from said hook, said rod having a first end pivotably mounted to the gate door with a fastener, wherein said first handle is located on a first side of said gate door and said second handle is located on a second side of said gate door, and wherein said actuating member comprises a cutout, and wherein a portion of said cutout forms said cam surface.

11. The gate latch assembly of claim 10, wherein said cam surface comprises a portion of a trapezoidal shaped cutout.

12. The gate latch assembly of claim 10, wherein said actuating member comprises a top edge and a bottom edge, said top and bottom edge being parallel, and wherein said cam surface comprises a first end and a second end, said first end being closer to said bottom edge than said top edge when compared to said second end.

13. The gate latch assembly of claim 12, wherein said biasing element biases the actuating member such that said rod is at said first end of said cam surface.

14. The gate latch assembly of claim 10, wherein a force exerted on said first handle in a first direction causes said actuating member to move such that said second end of said linear surface moves closer to said rod.

15. The gate latch assembly of claim 14, wherein a force exerted on said second handle the first direction causes said actuating member to move such that said second end of said linear surface moves closer to said rod.

16. The gate latch assembly of claim 10 wherein said biasing element comprises a bellows portion.

17. The gate latch assembly of claim 16 wherein said biasing element is secured to an inner cover and an outer cover.

18. The gate latch assembly of claim 17 wherein a portion of said actuating member is disposed between said inner and outer covers.

* * * * *